US006053634A

United States Patent [19]

Kay

[11] Patent Number: 6,053,634

[45] Date of Patent: Apr. 25, 2000

[54] CONVERTIBLE BAG

[76] Inventor: Julie D. Kay, 2310 Del Mar Rd., Suite 6, Montrose, Calif. 91020

[21] Appl. No.: 09/187,025

[22] Filed: Nov. 5, 1998

Related U.S. Application Data

[60] Provisional application No. 60/064,626, Nov. 7, 1997, and provisional application No. 60/093,003, Jul. 16, 1998.

[51] Int. Cl.[7] ..... B65D 33/06

[52] U.S. Cl. ..... 383/4; 190/901; 190/903; 383/6; 383/14

[58] Field of Search ..... 383/6, 14, 4; 190/901, 190/903

[56] References Cited

U.S. PATENT DOCUMENTS

| | | | |
|---|---|---|---|
| 1,883,702 | 10/1932 | Gomi | 383/14 |
| 2,536,169 | 1/1951 | Gray | 190/901 |
| 2,674,288 | 4/1954 | Laidlaw | 190/901 |
| 3,489,194 | 1/1970 | Hoover | 150/1 |
| 4,375,111 | 3/1983 | Hall | 5/419 |
| 4,712,258 | 12/1987 | Eves | 5/424 |
| 4,723,300 | 2/1988 | Aranow | 383/4 |
| 4,789,247 | 12/1988 | Schnoor | 383/4 |
| 4,886,150 | 12/1989 | Fitzsimmons | 190/1 |
| 4,984,906 | 1/1991 | Little | 383/4 |
| 5,088,139 | 2/1992 | Bloom | 5/420 |
| 5,110,219 | 5/1992 | Lopes | 383/4 |
| 5,199,120 | 4/1993 | Holmes | 5/419 |
| 5,210,891 | 5/1993 | Avital | 5/420 |
| 5,692,257 | 12/1997 | Albertieri | 5/655 |
| 5,730,529 | 3/1998 | Fritz et al. | 383/4 |

*Primary Examiner*—Stephen P. Garbe
*Attorney, Agent, or Firm*—Eric Karich

[57] ABSTRACT

A convertible bag for holding articles therein is arranged to be opened into a reclining mat to provide a sanitary surface for reclining a child thereon. An inner surface of the reclining mat includes a pillow compartment into which a pillow is removably secured. A pair of zippers are used to removably join the top and bottom panels to form the bag. The bag includes a pair of handle straps. The handle straps are attached to the bag to form at least one utility loop useful for attaching baby related paraphernalia such as pacifiers and toys, so they remain within the child's reach and they do not fall onto the floor and get lost. The handle straps preferably further includes a metal snap fasteners for removably attaching the handle straps to the outer surface of the reclining mat to prevent an infant from being strangled by a handle strap while lying on the reclining mat. The bag preferably includes a plurality of compartments for storing additional articles; and the bag preferably further includes an identification tag with emergency information regarding the child.

1 Claim, 4 Drawing Sheets

CONVERTIBLE BAG

BACKGROUND OF THE INVENTION

This application for a utility patent follows a first previously filed provisional patent having the serial No. 60/064,626 and a filing date of Nov. 7, 1997; and a second previously filed provisional patent having the serial No. 60/093,003 and a filing date of Jul. 16, 1998.

FIELD OF THE INVENTION

This invention relates generally to a tote bag for carrying baby accessories, and more particularly to a tote bag that converts into a sanitary baby changing surface that is also useful for providing a sanitary surface for napping.

DESCRIPTION OF THE INVENTION

The following art defines the present state of this field: Albertieri, U.S. Pat. No. 5,692,257, discloses a handbag that unfolds into a baby changing surface that includes a baby blanket. Fitzsimmons, U.S. Pat. No. 4,886,150, discloses a handbag for carrying baby-accessories, the handbag then unfolding into a baby-changing surface. Hoover, U.S. Pat. No. 3,489,194 discloses a tote bag that opens to form a baby changing surface having a comfortable foam surface. A similar diaper changing bag is disclosed in Aranow Rosalind B., U.S. Pat. No. 4,723,300, which discloses a tote bag that opens to form a baby changing surface that includes a moisture absorbing layer that can be easily removed and replaced with a fresh absorbent pad.

Additional bags that convert to sleeping surfaces are found in other fields that are not related to baby products. Schnoor, U.S. Pat. No. 4,789,247, discloses a beach blanket that folds into a tote bag. The blanket contains a pouch into which a pillow or similar support can be inserted. Holmes, U.S. Pat. No. 5,199,120, discloses a lounging mat and pillow combination that converts into a bag having a plurality of pouches. Avital, U.S. Pat. No. 5,210,891, discloses a portable foam mattress that folds into a handbag.

The prior art teaches various tote bags that are convertible into surfaces for diapering a baby. However, the prior art does not teach a tote bag that converts into a surface with the features of the present invention. The present invention fulfills these needs and provides further related advantages as described in the following summary.

SUMMARY OF THE INVENTION

The present invention teaches certain benefits in construction and use which give rise to the objectives described below.

The present invention provides a convertible bag for holding articles therein, the bag being arranged to be opened into a reclining mat to provide a sanitary surface for reclining a child thereon. An inner surface of the reclining mat includes a pillow compartment into which a pillow is removably secured. A closure means, preferably a pair of zippers, is used to removably join the top and bottom panels to form the bag. The bag includes a pair of handle means for providing a handle for the user to easily carry the bag. The handle means includes a utility loop useful for attaching baby related paraphernalia such as pacifiers and toys, so they remain within the child's reach and they do not fall onto the floor and get lost. The handle means preferably further includes a safety snap means for removably attaching the handle means to the outer surface of the reclining mat to prevent an infant from being entangled or strangled by a handle strap while lying on the reclining mat. The bag preferably includes a plurality of compartments for storing additional articles such as toys, bottlcs, and diapers. Finally, the bag preferably includes an identification tag with emergency information regarding the child.

A primary objective of the present invention is to provide a convertible bag having advantages not taught by the prior art.

Another objective is to provide a bag that converts into a reclining mat having a pillow on its inner surface.

Another objective is to provide a bag including a utility loop that can be used to anchor baby paraphernalia within reach of the child.

Another objective is to provide a bag having a handle means that will not entangle or strangle a child that is lying on the reclining mat.

A further objective is to provide a bag that can be closed in two configurations: first, closing the bag only on three sides, thereby leaving the top open; and second, closing the bag on all sides, scaling articles inside the bag.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
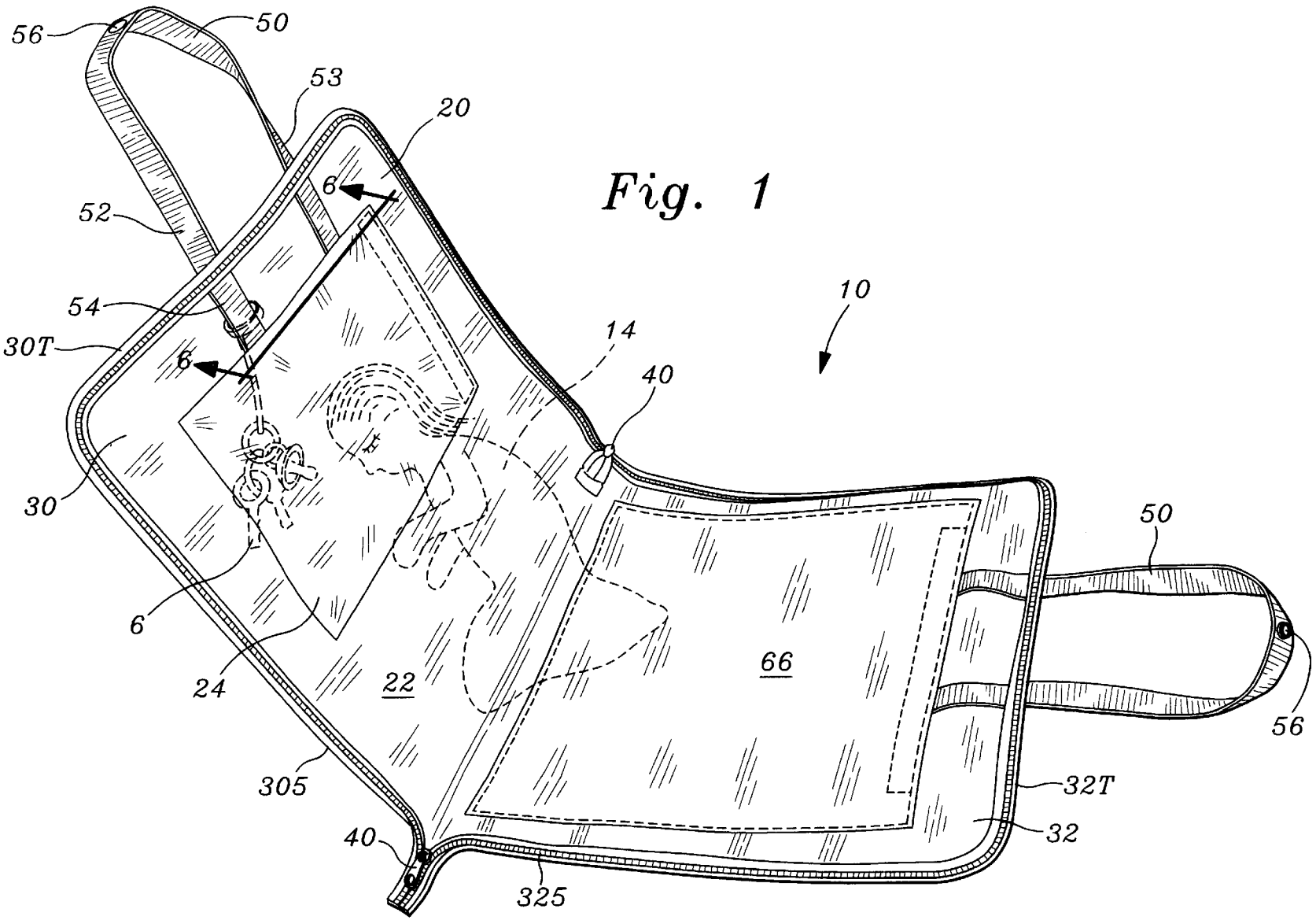
FIG. 1 is a top plan view of the preferred embodiment of the present invention, the convertible bag being opened to form a reclining mat upon which a baby may be placed for napping.

The above described drawing figures illustrate the invention, a convertible bag 10 for holding articles 12 therein. The bag 10 is useful for carrying articles 12 such as bottles, diapers, books, toys, and snacks. The bag 10 is arranged to be opened to provide a sanitary reclining mat 20 and pillow 24 for lying a child 14 thereon. A sanitary surface is particularly useful to persons with infants, who require diapering, or young children, who need a sanitary surface upon which to nap while is school. Using the sanitary surface provided by the bag 10 helps parents protect their child 14 from lice and other contagions often found in public places.

Figure 2:
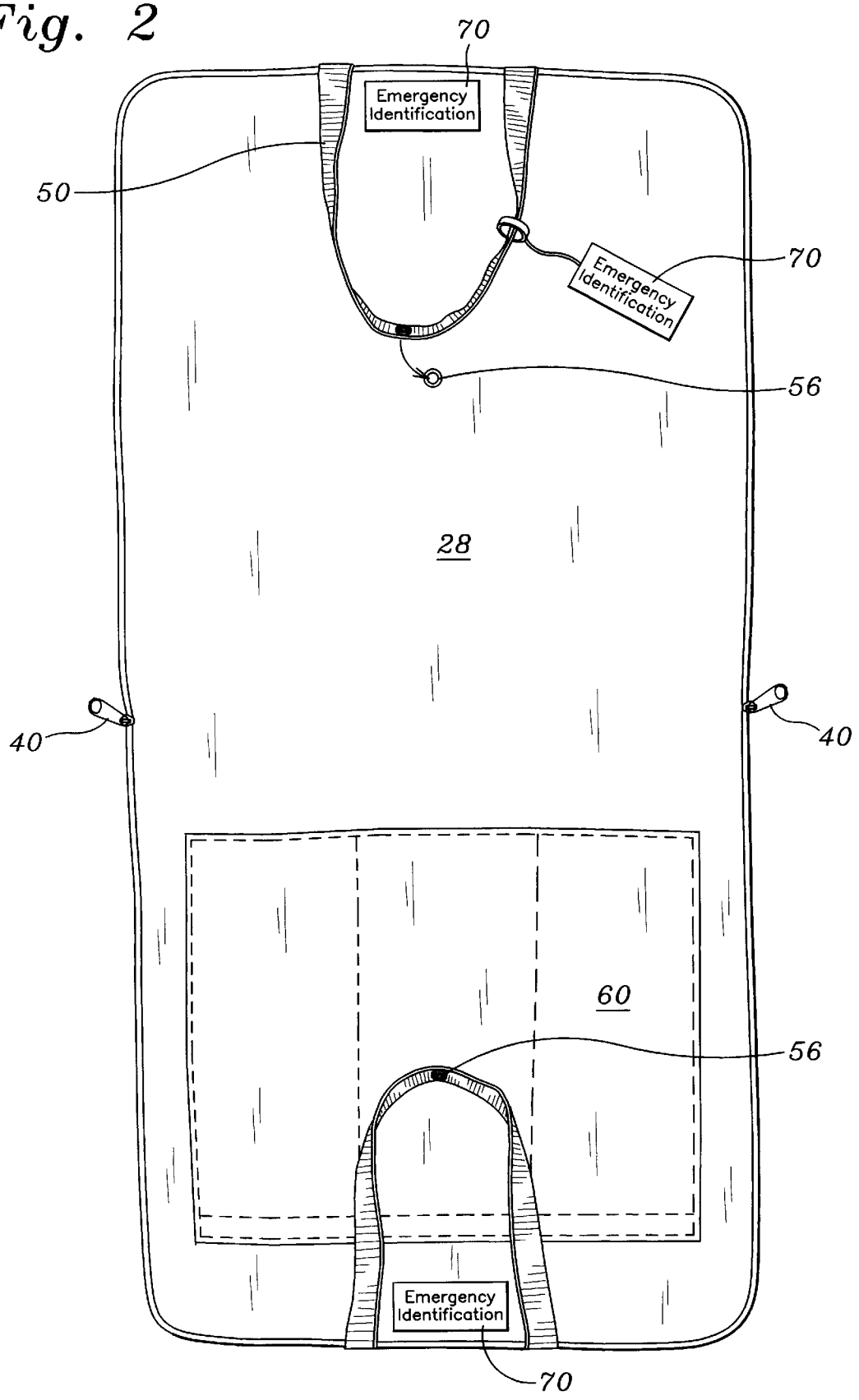
FIG. 2 is a bottom plan view thereof, showing a pair of handle straps fastened to an outer surface of the reclining mat to prevent an infant from being entangled or strangled by the handle straps.

As shown in FIGS. 1 and 2, the bag 10 opens to form the reclining mat 20 having an inner surface 22 and an outer surface 28. A pillow 26 is secured to the inner surface 22. In its preferred embodiment, the inner surface 22 includes a pillow compartment 24 into which a pillow 26 is removably secured. To comply with health and safety regulations, the pillow compartment 24 is preferably completely sealed closed with hooks and loops, commonly known as Velcro®. The pillow 26 is preferably a sanitary polycotton pillow with complete surged edges complying with all government health and safety regulations. When the user needs to place the child 14 in a reclining position, for diapering et cetera, the child 14 may be placed upon the inner surface 22 of the reclining mat 20 with his or her head on the pillow 26. The inner surface 22 provides a sanitary surface that prevents lice or other contagion from infecting the child 14. The reclining mat 20 is preferably 16 inches wide and 39.5 inches long, although this size can vary upon the specific needs of the intended user. The reclining mat 20 is preferably constructed of a flexible, quilted material such as cotton, although those skilled in the art may devise alternative materials or combinations that provides a comfortable padded surface for the child 14 without making the bag 10 overly heavy or bulky. Those skilled in the art may also include absorbent material, waterproof material, and foam padding. Additional details of construction are included in Albertieri, U.S. Pat. No. 5,692,257, Fitzsimmons, U.S. Pat. No. 4,886,150, and Aranow Rosalind B., U.S. Pat. No. 4,723,300; these details being hereby incorporated by reference in full.

Figure 3:
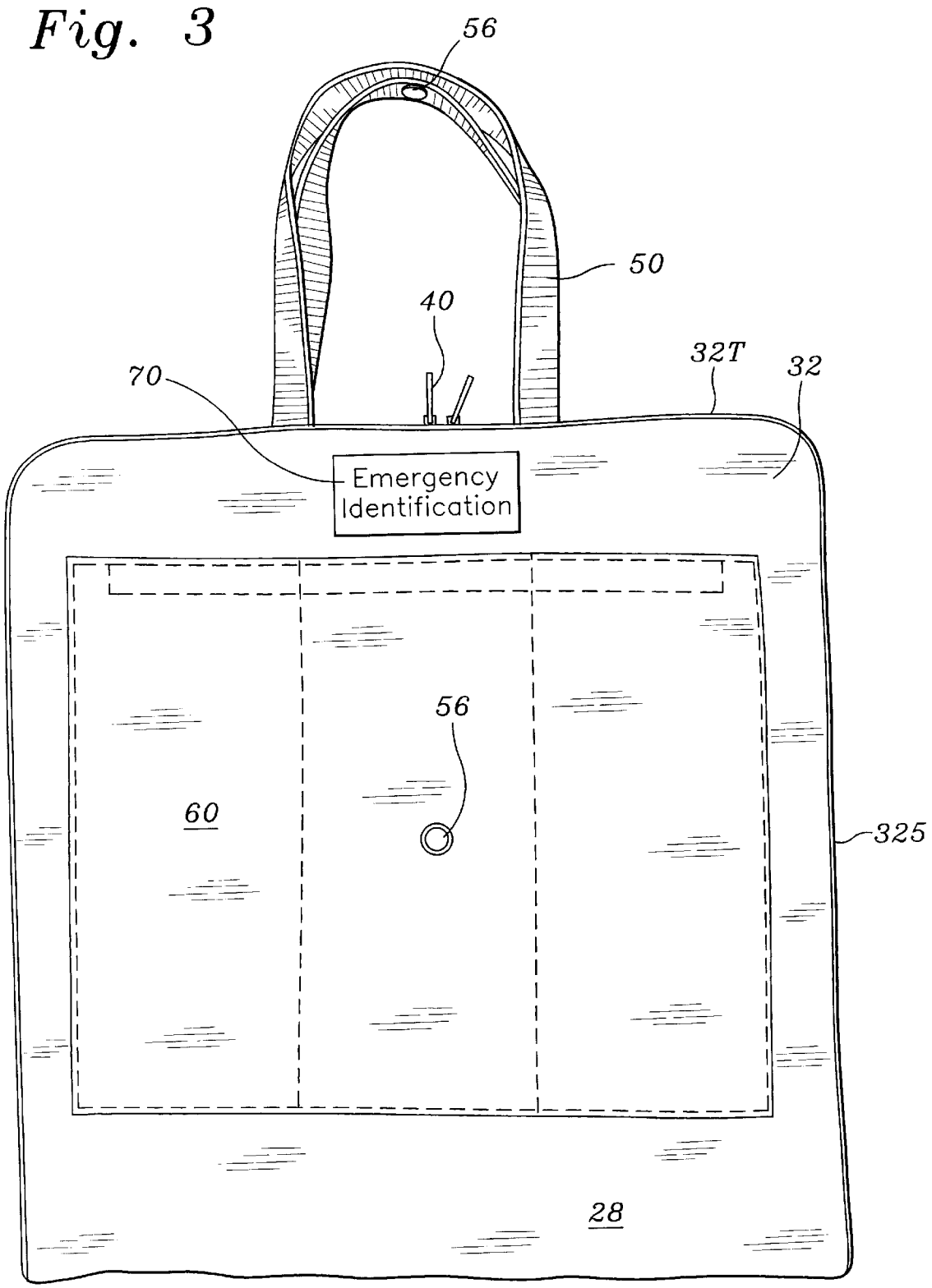
FIG. 3 is a top perspective view thereof, showing the pair of zippers partially closing the sides of the bag.
Figure 4:
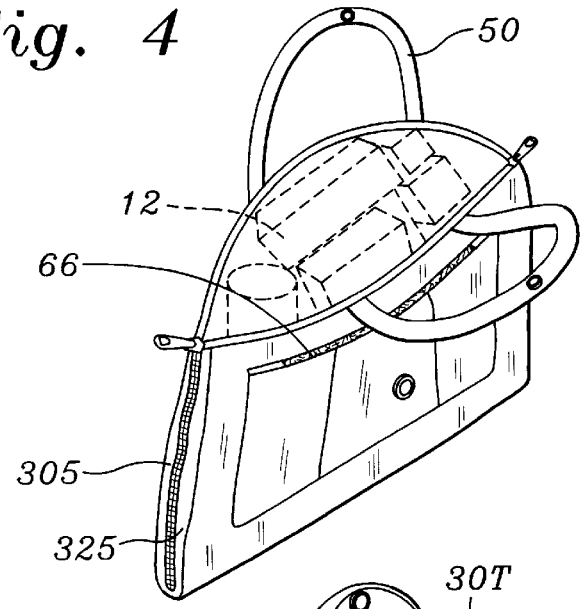
FIG. 4 is a perspective view of the convertible bag with the zippers in a first bag configuration, thereby allowing the bag to be filled with a large volume of articles.
Figure 5:
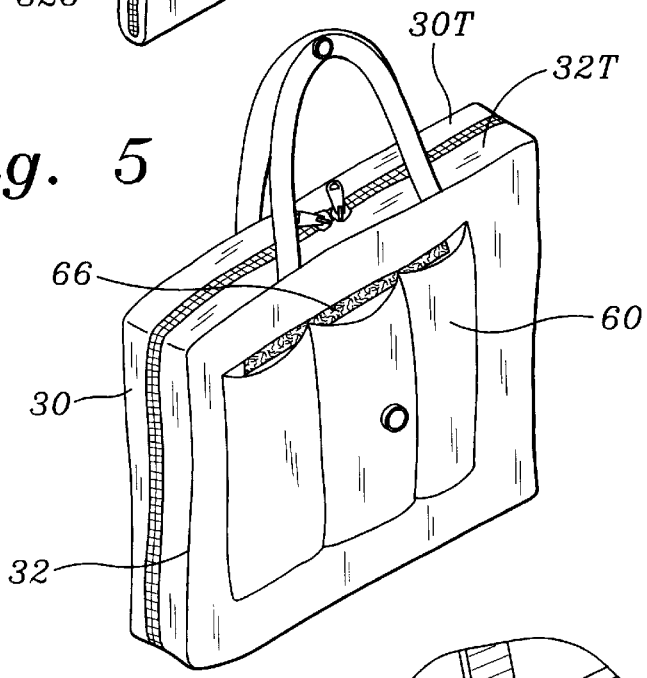
FIG. 5 is a perspective view of the convertible bag with the zippers in a second bag configuration, thereby sealing the articles within the bag.

As shown in FIG. 3, the reclining mat 20 is foldable to form a top panel 30 and a bottom panel 32, the top and bottom panels 30 and 32 each having a pair of opposing side edges 30S and 32S and a top edge 30T and 32T. A closure means 40, preferably a pair of zippers, is used to removably join the top and bottom panels 30 and 32 to form the bag 10. Each zipper 40 removably joins the top and bottom panels 30 and 32 by their corresponding side edges 30S and 32S to form a first bag configuration. In this first bag configuration, shown in FIG. 4, the bag 10 is useful for carrying a large volume of articles 12. At least one of the zippers 40 may also be used to removably join the top and bottom panels 30 and 32 by their corresponding top edges 30T and 32T to form a second bag configuration. In this second bag configuration, shown in FIG. 5, the bag 10 is useful for removably sealing the articles 12 within the bag 10.

Figure 6:
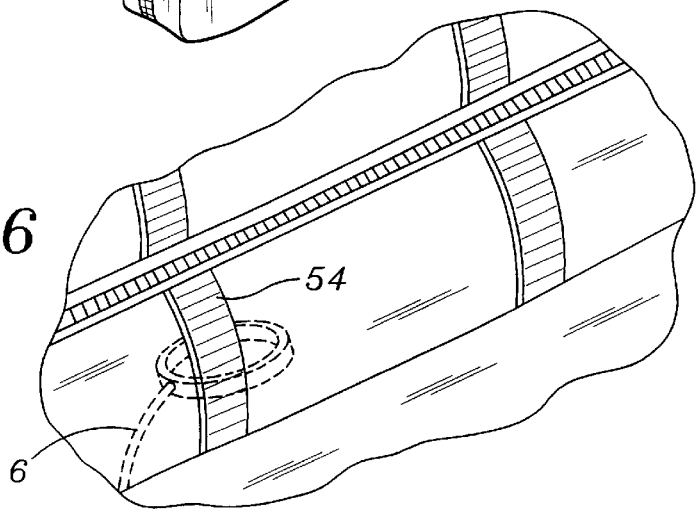
FIG. 6 is a close-up view of a utility loop of the invention taken along line 6—6 in FIG. 1.

The bag 10 includes a pair of handle means 50 for providing a handle for the user to easily carry the bag 10. One of the handle means 50 is attached to the top panel 30 and the other is attached to the bottom panel 32. Each of the handle means 50 is preferably a handle strap made of nylon webbing. Each handle strap 50 has opposing ends 52 and 53, each of the opposing ends 52 and 53 being attached to the reclining mat 20. In its preferred embodiment, as shown in FIG. 6, the opposing ends 52 and 53 of each handle strap 50 are attached to the inner surface 22 of the reclining mat 20 in two places, forming a utility loop 54 therebetween. Each of the opposing ends 52 and 53 are attached to the inner surface 22 of the bag 10 in tow places to form the utility loop 54. One end of the utility loop 54 is preferably sewn between the top panel 30 and the pillow compartment 24 and the other end is preferably sewn between the top panel 30 and the closure means 40. The utility loop 54 is useful for attaching, directly to the bag 10, baby related paraphernalia such as pacifiers and toys, so they remain within the child's reach and they do not fall onto the floor and get lost. As shown in FIG. 2, the handle strap 50 preferably further includes a safety snap means 56 for removably attaching each of the handle straps 50 to the outer surface 28 of the reclining mat 20 to prevent an infant from being entangled or strangled by a handle strap 50 while lying on the reclining mat 20. The safety snap means 56 is preferably a metal snap fastener well known in the art, although other fasteners are also acceptable.

The bag 10 preferably includes a plurality of compartments 60 and 66 for storing additional articles such as toys, bottles, and diapers. In its preferred embodiment, the bag 10 includes an outer compartment 60 in the outer surface 28 of the bottom panel 32. The outer compartment 60 is preferably divided into three sub-compartments for holding bottles. The outer compartment 60 is preferably lined with vinyl to protect against liquid spills. In the preferred embodiment, the bag 10 further includes an inner compartment 66 located in the inner surface 22 of the bottom panel 32. The inner compartment 66 is designed to hold toys and other paraphernalia safely within the bag 10. Both the inner and outer compartments 60 and 66 preferably include outer and inner hooks and loops fasteners, 62 and 68 respectively, to seal articles within the compartments. In the preferred mode, the hooks and loops fasteners 62 and 68 only cover part of the opening of the compartments 60 and 66, making it easy for the user to get his or her fingers into the compartments and pull open the hooks and loops fasteners. Finally, the bag 10 preferably includes an identification tag 70 with emergency information regarding the child 14. The identification tag 70 may be attached to many different locations around the bag 10. As shown in FIG. 2, the identification tag 70 is preferably attached directly to the outer surface of the bag; alternatively, the identification tag 70 may be attached to one of the handle straps 50.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A convertible bag for holding articles therein, the bag being arranged to be opened to provide a sanitary surface for reclining a child thereon, the bag comprising:

a reclining mat having an inner surface and an outer surface, the reclining mat being foldable to form a top panel and a bottom panel, the top and bottom panels each having a pair of opposing side edges and a top edge;

a pair of zippers, each zipper being positioned for removably joining the top and bottom panels by one of their corresponding side edges as well as at least part of the top edges, the pair of zippers thereby forming the bag;

a pair of handles, each of the pair of handles having a pair of opposing ends, one of the pair of handles being attached at its opposing ends to the bottom panel, and the other of the pair of handles being attached at its opposing ends to the top panel, at least one of the opposing ends being attached to the inner surface of the top panel in two places, forming a utility loop therebetween; and a pillow secured to the inner surface of the top panel.

* * * * *